US008443747B1

(12) United States Patent
Cardarelli et al.

(10) Patent No.: US 8,443,747 B1
(45) Date of Patent: May 21, 2013

(54) MOORING PENDANT APPARATUS

(76) Inventors: Venanzio Cardarelli, Plymouth, MA (US); Ronald A. Wolf, Plymouth, MA (US)

( * ) Notice: Subject to any disclaimer, the term of this patent is extended or adjusted under 35 U.S.C. 154(b) by 0 days.

(21) Appl. No.: 13/373,565

(22) Filed: Nov. 18, 2011

Related U.S. Application Data

(63) Continuation-in-part of application No. 13/200,633, filed on Sep. 27, 2011, now Pat. No. 8,327,788, which is a continuation-in-part of application No. 13/199,248, filed on Aug. 24, 2011, now Pat. No. 8,342,116.

(51) Int. Cl.
*B63B 21/00* (2006.01)

(52) U.S. Cl.
USPC ..... 114/221 R

(58) Field of Classification Search
USPC ..... 24/599.1, 599.4, 599.6, 599.8, 600.9; 294/191, 175, 26, 82.1, 82.19; 114/221 R, 114/230.1, 230.2, 230.3, 230.25, 230.26, 114/230.15
See application file for complete search history.

(56) References Cited

U.S. PATENT DOCUMENTS 653,021 A 7/1900 Hamilton
2,246,630 A * 6/1941 Johnson ..... 294/174
4,595,223 A 6/1986 Hawie
4,817,551 A * 4/1989 Matson ..... 114/230.15
5,243,926 A 9/1993 Wright et al.
5,301,628 A 4/1994 Daskalides
5,381,749 A 1/1995 Larson
5,398,634 A 3/1995 Eagan
5,538,303 A 7/1996 Dunham
5,634,421 A 6/1997 Velarde
5,820,181 A * 10/1998 Le Noach ..... 294/82.19
6,273,017 B1 8/2001 Griffin
6,363,876 B1 4/2002 Blake
6,390,009 B2 5/2002 Brown et al.
6,450,558 B1 9/2002 Ringrose
6,772,488 B1 * 8/2004 Jensen et al. ..... 24/599.6
7,089,877 B1 8/2006 Hay
7,096,813 B1 8/2006 Luck
7,712,804 B2 5/2010 Leyden et al.
7,757,360 B1 7/2010 Hong

* cited by examiner

*Primary Examiner* — Edwin Swinehart
(74) *Attorney, Agent, or Firm* — D. Michael Burns

(57) ABSTRACT

A releasable mooring pendant apparatus that can be coupled or decoupled to a boat. The apparatus comprising of a pair of clips, one at each end of a rod, with each clip comprising hook and ring sections, and an opening therebetween defining a mouth. A movable arm placed under tension to biasly maintain each clip in a closed position, and each clip may only be opened upon activation through the intermedium of a functional retractor lever by a boater pulling on a cable, wherein a functional retractor lever causes a greater force on the movable arm such that the clip is caused to open. The mooring pendant apparatus operates as an extension of the boater's arm, and it can be utilized either by keeping the apparatus on the boat or leaving it connected to the mooring line and also to the mooring ball.

3 Claims, 4 Drawing Sheets

MOORING PENDANT APPARATUS

CROSS-REFERENCE TO RELATED APPLICATIONS

This application is a continuation-in part of U.S. patent application Ser. No. 13/200,633, filed Sep. 27, 2011, now U.S. Pat. No. 8,327,788 which is a continuation-in-part of U.S. patent application Ser. No. 13/199,248 filed Aug. 24, 2011, now U.S. Pat. No. 8,342,116 the disclosures of which are incorporated by reference herein in their entirety.

FIELD OF THE INVENTION

This invention relates to an apparatus for releasably coupling and decoupling clips to facilitate mooring a boat. More specifically, the apparatus allows for easier attachment of a mooring line to the bow of a boat.

BACKGROUND OF THE INVENTION

Pleasure boats, such as yachts and small boats, are often moored to either a dock cleat or a mooring buoy. The mooring line is tied around the dock cleat or through a mooring ring on a buoy. Preferably the mooring line is tied to a ring or eye member that is found on the bow of the boat. Because of the difficulty in securing a mooring rope to a relatively remote eye member, such as one found on the bow of a boat, the boater often neglects this procedure and only ties the boat to the cleats on the top surface of the boat. The difficulty created in trying to tie the rope to the buoy ring may be just as hard because the boater must reach down for the buoy and then often must pull it up to tie the line. If the mooring line cannot be pulled up, due to factors such as weight or tension in its anchor line, a second person is usually required. The problem encountered in trying to tie a mooring rope to the ring on the bow of a boat is usually due to the awkward position in which most bow rings are located. Reaching over and trying to reach the bow ring may be very hazardous to a boater, especially in rough waters. An unassisted boater may even find it impossible to moor his boat. It may be especially difficult to attach and detach a tie line to a mooring buoy or a boat bow ring or eyelet, in situations where a boat is not small enough to permit the user to reach down and manually fasten or unfasten the clip. Also, tying the mooring line to cleats on the deck of the boat creates chafe which can weaken and eventually cause failure of the mooring line. And, with more boats being built with pop-up or pull-up cleats there is the problem of failure from the constant stress of the mooring line. When the freeboard is large, the boatsman must use a long boat hook or gaff to reach down and snag the mooring line and lift it up to height where he can manually snap or unsnap the clip from the buoy or bow eye member.

Remote control attachment assemblies are commercially available and such assemblies usually comprise a slide member designed to be attached to a conventional elongated boat hook and then the hook is retained in an open position. This enables the open hook to engage the eye member of the mooring buoy or bow ring. Such assemblies are often difficult to use. The present invention has found that the type of devices which are generally considered the easiest to operate are those employing a long rod which acts as an extension of the boater's arm and then has a clip located on each end wherein the opening and closing of the clips by remote means eases the burden of the procedure.

SUMMARY OF THE INVENTION

The present invention overcomes the problems outlined above and provides safe and convenient clips for docking a boat to a mooring structure with the aid of a mooring pendant apparatus. The apparatus releasably couples or decouples to an eyelet on the bow of the boat or to a buoy. The apparatus includes a pair of clips, one on each end of an elongated rod, wherein the clips open and close for attachment or release. The clips each comprise integral hook and ring sections which define a mouth therebetween. Each hook section includes an attachment hook which attaches to a movable arm having an upper bridge section, wherein means are provided to force the movable arm into the attachmet hook and therein exert a tension on the bridge section to keep the clip biasly in a closed position.

One embodiment teaches that both ring sections include an access of rotation hole to provide an anchoring position for a functional retractor lever. Levers include a pair of right and left lower and upper arm sections, the lower and upper arms forming a variable angular deviation in relationship to each other. The retractor levers each include a functional contact section for engaging a movable arm into an open or shut position and a variable curved lever arm having at a distal end an extension piece that is frictionally fitted with great bias into an axis of rotation hole, therein creating the torque for the retractor lever to operate. The movable arm of each clip has an upper bridge section that is snap-locked into the hook section to close the mouth. The movable arm is placed under tension by the stress created in geometric positioning of a pair of leg sections. A long leg section extends downwardly and at a distal end fits an insertion piece into a lower opening in the ring section and a shorter leg section also having an insertion piece that fits into an upper opening in the ring section. This leg design produces a torque on the movable arm urging it to be biased in a closed position.

The invention uses a pair of cables, a first cable attached to the first retractor lever and a second cable attached to the second retractor lever for activation of the clips. These cables first pass through a fixed handle that keeps them aligned for use, and then each cable is secured to an opposite end of a single sliding handle, wherein a boater may pull on the sliding handle with sufficient force to overcome either of the locking tensions placed on the movable arm.

An embodiment of the invention utilizes a method for placing the movable arm under tension, wherein an internal spring is located in a movable arm to exert the tension necessary to lock the arm into the hook of the clip. This embodiment employs both a left and right arm having an angular deviation. The arms formed in a bowed position in relationship to each other, and the pull on the movable arm is on both sides of the arm.

While many other materials may be used, the clips, and the rods of the mooring pendant apparatus are preferably formed out of stainless steel or brass and also may be cast or forged. When not cast the rod is integrally connected to the clips by welding. While many materials may be used to withstand the harsh conditions and weather, the cable is preferably formed from aircraft cable or polyvinyl-chloride coated steel.

Several embodiments of clips have been discussed, and it is to be appreciated that various combinations of clips may be utilized.

DETAILED DESCRIPTION OF THE INVENTION

Preferred embodiments of the invention will now be described with reference to the Figures. Some terms used in the description and the appended claims are defined below.

Figure 1A:
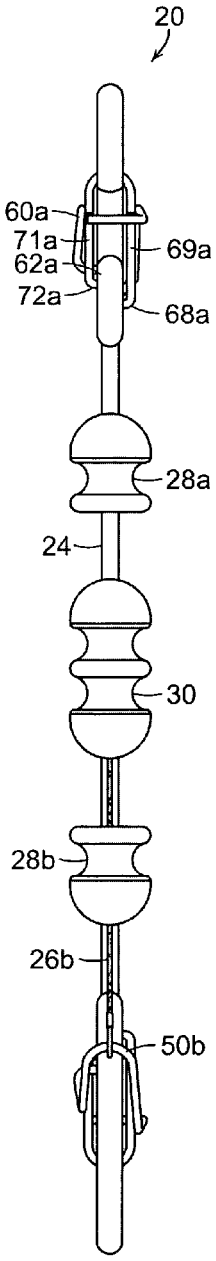
FIG. 1*a* is an elevational left side view of the apparatus of FIG. 1.
Figure 1:
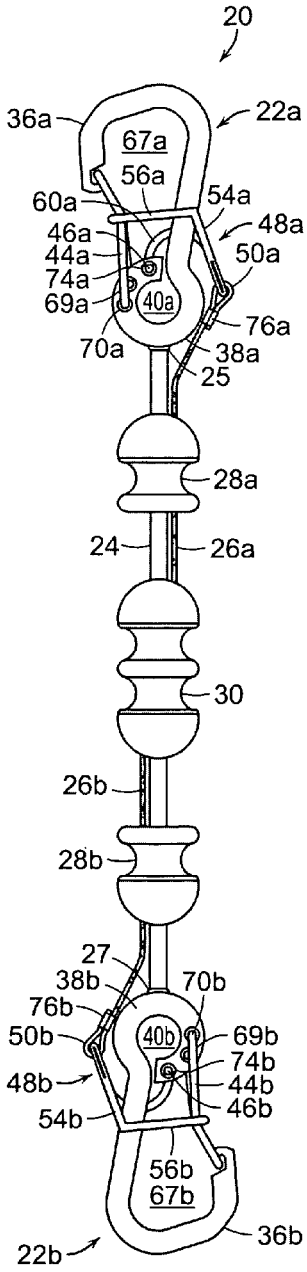
FIG. 1 is an elevational front view of an apparatus for mooring a boat, according to the present invention, and is shown in a closed position.
Figure 1B:
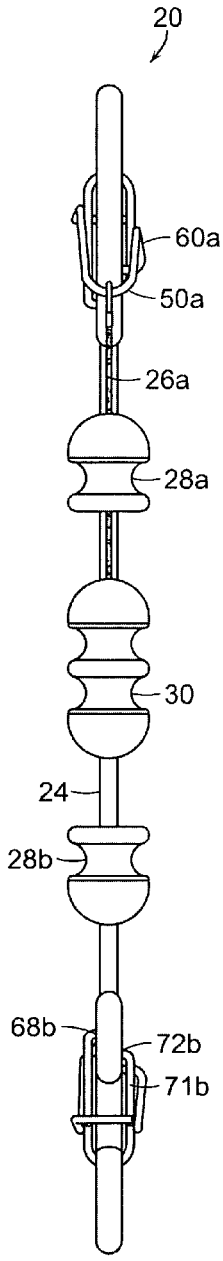
FIG. 1*b* is an elevational right side view of the apparatus of FIG. 1.

Referring to FIG. 1, the illustrated mooring pendant apparatus 20 is comprised of the following portions: a first clip 22*a* and a second clip 22*b*; an elongated rod 24 having a means for connecting the first and second clips to opposite ends of the rod; a first cable 26*a* and a second cable 26*b*, oriented such that when either is pulled or released one of the clips is activated. The pendant apparatus also includes a first fixed handle 28*a* and a second fixed handle 28*b*, and a sliding handle 30. The pendant apparatus 20 facilitates the placement and removal of the clips 22*a*, 22*b* from a boat ring (not shown) or a mooring ball (not shown). The clips 22*a*, 22*b* connect to a boat ring and/or to a mooring ball through the medium of a mooring line (typically a rope) for the proper securing of the watercraft while in the water. Mooring lines are varied in size and design. Some have loops on both ends, and can be attached very simply to the apparatus 20. Some may have both a loop and/or clip and wherein both can be accommodated. The boater may also opt to keep the apparatus on board and connect to the mooring line, depending on the connectivity design chosen for that particular mooring line. The present apparatus 20 aids the boater in attaching either first 22*a*, or second 22*b* clips to the boat ring/eyelet which is usually located on the bow of the boat, and which is often in a very precarious place to reach. In the boating industry, the design and location of boat rings were carefully engineered for function, and not convenience, therein they are usually placed for an attachment site which is closer to the surface of the water. This design inherently reduces stress by lowering the center of gravity and rotation and by utilizating the framework of the boat itself to handle stress. The use of the present invention not only helps the boater with the ease of placement and removal of the clips 22*a*, 22*b* but also aids in the proper stabilization of the boat when moored.

Figure 2B:
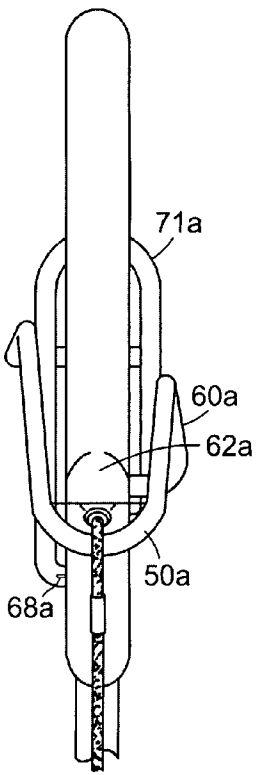
FIG. 2*b* is a right elevational view of FIG. 2.
Figure 2:
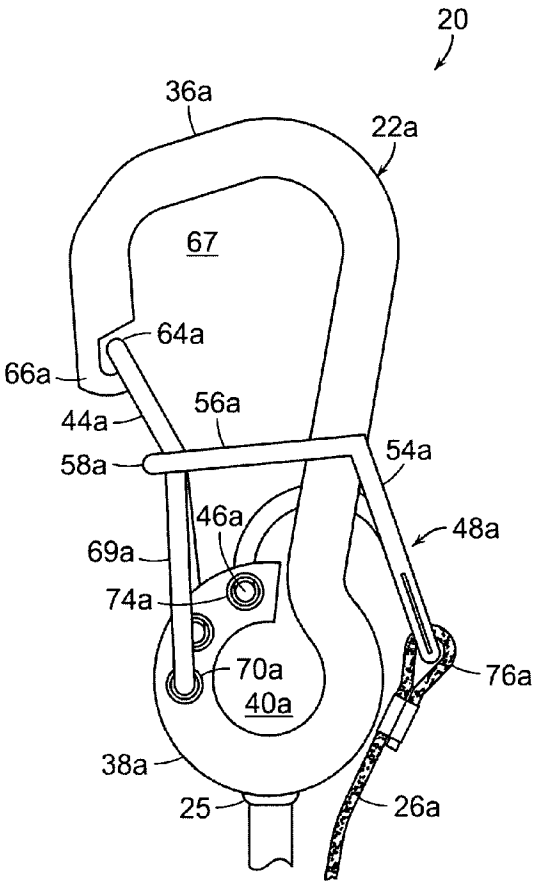
FIG. 2 is an elevational front view of the clip part of the apparatus with the cable attached to the retractor lever.
Figure 2A:
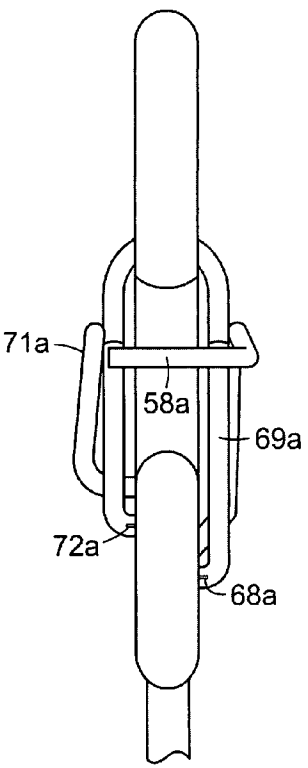
FIG. 2*a* is a left elevational view of FIG. 2.

The present invention uses one of the more common commercially available clips and then alters that clip in a most novel manner. As best illustrated in FIGS. 1, 1*a*, 1*b*, and 2*a* to 2*b*, which show the rod 24 having first and second clips 22*a* and 22*b*, mounted on opposing ends, it is to be noted that the clips 22*a*, 22*b* are mirror images of each other. The clips 22*a* and 22*b* are comprised of: hook sections 36*a* and 36*b*, integral ring sections 38*a*, 38*b* that have central openinpgs 40*a* and 40*b* in which a mooring line (Not shown) may optionally be tied; movable arms 44*a* and 44*b* which are functional for opening and closing mouths 67*a* and 67*b* of the clips 22*a* and 22*b* respectively; access of rotation holes 46*a* and 46*b* defined in the rings 38*a* and 38*b* at unique sites for anchoring the functional retractor levers 48*a* and 48*b* which control the motion of the movable arms 44*a* and 44*b* repectively. The retractor levers 48*a* and 48*b* (best shown in FIGS. 2*a*-2*b*) are each comprised of: connection sections 50*a* and 50*b* which are attached to one of the pull cables 26*a*, 26*b* (discussed below), and the first clip 22*a* is best seen on FIGS. 2, 2*a* and 2*b*. Since the first and second clips 22*a* and 22*b* are mirror images of each other, liberty has been taken at times in which only one clip is described in detail. It should be noted that the lower and upper arm sections 54*a* and 56*a*, form an angular deviation in relationship to each other, and it is important to note that these angular deviations may be varied. The retractor lever 48*a* includes: a functional contact section 58*a* for engaging the movable arm 44*a* into an open or shut position upon activation; and a variable curved lever arm 60*a* having at a distal end an extension piece 62*a* that is frictionally fit with great bias into the axis of rotation hole 46*a*, therein creating the torque rotation axis for the retractor lever 48*a*. The movable arm 44*a* of the clip has an upper bridge 64*a* that is locked by snap-fitting into a hook 66*a* therein keeping the mouth 67*a* biasly closed until it is overcome with a greater force to open it.

The movable arms 44*a*, 44*b* have long leg sections 69*a*, 69*b* extending in a downwardly direction and at distal ends, insertion pieces 68*a*, 68*b* which frictionally fit with great bias into a lower openings 70*a*, 70*b* respectively, and also the movable arms have shorter second legs 71*a*, 71*b* having an insertion pieces 72*a*, 72*b* which friction fit into upper openings 74*a*, 74*b*. The design of the movable arms 44*a*, 44*b* is such that they have a bend. Such a design allows for the movable arms to be placed under tension resulting in a natural state of closure. The clips of the invention utilize carefully engineered locations for holes on the ring structure. The site for the access of rotation holes 46*a*, 46*b* were carefully chosen to insure that the clips would not be weakened structurally. The design of the movable arms 44*a*, 44*b* and the manner they are bent is part of the inventive concept. Such a design allows for the movable arm to be placed under tension resulting in a natural state of closure. As previously stated, it is preferred that the clip be manufactured for a solid piece of stainless steel, however brass or some other corrosion resistant material may be utilized without compromising the inventive concept.

A first end 25 of the elongated rod 24 is integrally attached to the first ring 38*a* as art of a cast, welded, forged, or combination thereof. The rod 24 extends through both the first fixed handle 28*a*, then through the sliding handle 30, and finally through the second fixed handle 28*b* wherein a second end 27 of the rod 24 is attached to the second clip 22*b*. The first or second clips 22*a*, 22*b* may be used to tie a mooring rope/line. As best seen on FIGS. 3-5, a channel 80 and a beveled conduit 78*a* are defined in the fixed handles 28*a*, 28*b*, and in the sliding handle 30 for passage of the rod 24, and cables 26*a*, 26*b* respectively. The bevel edge of the conduit 78*a* allows for a minimization of the resistance therein. In the manufacture of the handles, both fixed 28*a*, 28*b*, and sliding 30, the fixed handles have defined locations for the threaded holes 82 which with the use of insert screws allow fixation to the rod 24. Both the fixed and the sliding handle will have threaded channels to fixate the two halves to one another. The insert screws are capped to protect them from the environment.

The mooring line referred to above is usually a strong and sturdy rope. When the mooring pendant apparatus 20 is kept in the boat, the connectivity is usually made to one of the clips

22*a*, 22*b* connecting to the mooring line either through a clip on the line or a loop on the line, and then the boater proceeds to secure the boat by connecting the apparatus to the bow ring utilizing the opposite clip on the apparatus 20. While one of the mooring lines is utilized by the apparatus, the second mooring line is usually connected to one or more of the cleats on the boat. The length of the pendant apparatus 20 is a variable based on how much a boater can handle. Since it is an extension of one's arm, reaching and securing the line to the bow ring is made slightly easier, provided that the apparatus is kept within a reasonable length and weight.

In any discussion of the clips 22*a* and 22*b*, if only one of the clips is mentioned, the discussion will apply to both clips as they are mirror images of each other. As described already, the movable arms 44*a*, 44*b* are the active part of the clips, as this is where the tension is created as a result of the design of the length of the long legs 69*a*, 69*b*, and short legs 71*a*, 71*b* and their positioning that keep the movable arm biased in the closed position. This is the functional component of the clips, since by pulling on either of the cables 26*a*, 26*b*, through the intermedium of the designed functional retractor lever, the mouths of the respective clips open, and by releasing the cables, the mouths close.

The elongated rod 24 serves as an extension of one's arm, and may be of any length or diameter or geometric configuration as well. The handles, fixed 28*a*, 28*b*, and sliding 30, require a channel 80 to be of a size and shape to accommodate the rod 24. When a circular cross-sectional rod is used there may be a tendency for the sliding handle to rotate on the rod. The location of the fixed handles may aid in limiting the rotation of the sliding handle. The rotation of the sliding can also be limited by a preferred embodiment utilizing a hexagonal or oval shaped rod as well as a rod with controlled curvatures in key locations.

The retractor arm 48*a* forms part of a unique design of the present invention. As previously cited, it has two arm sections, a lower arm section 54*a* and an upper arm section 56*a* which are bent in relationship to each other, therefore forming an angular deviation which may be variable. The bending of the retractor arm 48*a* lowers it in such a manner that it is in closer proximity to the rod 24, and the design of the angular deviation is a factor in the exertion necessary for the pull cable 26*a*. The contact section 58*a* of the retractor arm 48*a* maintains direct contact with the movable arm 44*a*. This provides the functional aspect of the invention, such that when the cable 26*a* is pulled, it exerts a rotational force around the axis of rotation within the access hole 46 thereby applying pressure on the movable arm 44 by pulling it backwards to cause it to separate from the hook 66, and thereby open. The reverse of this action is such that upon releasing the pull on the sliding handle 30, the cable tension is also lessened hereby closing the clip 22*a*. It is shown on FIGS. 2, 2*a* and 2*b*, that the contact section 58*a* embraces both, the longer arm 69*a* and the shorter arm 71*a* sections of the movable arm 44*a* and by pulling on both sections evenly, there is no deviation or deformation caused by an uneven pull. This is best achieved by controlling the angle formed by the upper and lower arm sections 56*a*, 54*a* of the retractor arm 48*a*, and the angle between the upper arm section and the contact section 58*a* of the retractor lever 48*a*. As previously stated, the angular deviation between the arm sections may be varied.

The cables 26*a*, 26*b* can be made of any material having the strength and capability to handle salt water, controlled elongation under wet conditions, as well as the effects of warm or cold temperatures. Materials may include rope or aircraft cable, but any wire, cable or rope may be substituted provided it can cope with the harsh environment without any elongation problems. Aircraft cable is preferred for the present invention and it has shown excellent controlled elongation under wet conditions. If stainless steel is used, it is better if coated so that it is not be abrasive to the system or to the grasp of the user's hands. Lack of elongation is critical as any elongation of the cable would affect the distance in which the movable arms open and close, as the distance of the sliding handle pull is essentially measured. As stated both cable 26*a*, 26*b* have one end attached to the looped section of the retractor arms 48*a*, 48*b* and are secured with a ferrule clip 76*a*, 76*b*. The cables freely move through the beveled conduits 78*a* and 78*b*, without hindrance or resistance, and connect to the sliding handle 30, wherein they are secured internally. In the present invention, the fixed handles 28*a* and 28*b* are firmly connected to the rod 24 and the sliding handle 30 is positioned at a certain distance above the fixed handle but not secured firmly to the rod 24. The distance between the fixed handle and the sliding handle is established by how much the sliding handle 30 has to be pulled towards the fixed handles 28*a*, 26*b* to completely open the mouth of the clip. Therefore, it is critical that the cable maintain its length with no elongation allowed.

Figure 3:
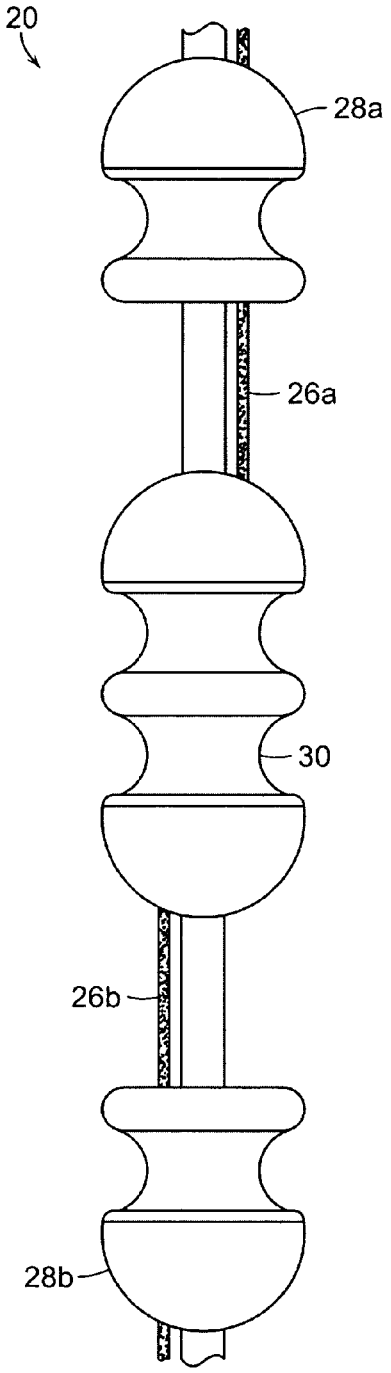
FIG. 3 is a section of the apparatus showing the two fixed handles and the sliding handle.
Figure 4:
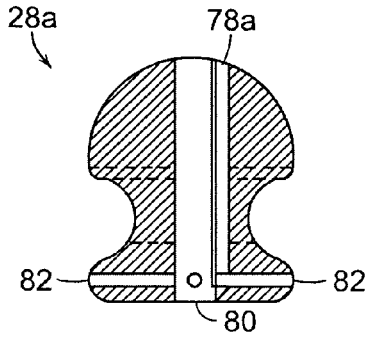
FIG. 4 is a cross-sectional of a fixed handle of the apparatus.
Figure 5:
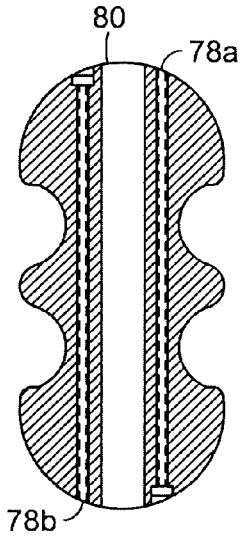
FIG. 5 is a cross-sectional of the sliding handle of the apparatus

As shown in FIGS. 3 and 4, the fixed handles 28*a*, 28*b* are connected to the rod 24 by conventional threaded holes and inset screws. The sliding handle 30 is also held together in the same manner by inset screws but is not fastened securely to the rod, but rather is in a slidable relationship with the rod. Both the fixed, and sliding handles 28*a*, 28*b* and, 30, were designed such that their convex outermost parts act as bumpers when the hull is in a slack tide, and therein allow the system to come into contact with the bow of the boat without causing any degree of damage. Both, the first and second fixed handles 28*a*, 28*b* help to eliminate the need for the user to have to grasp and pull the sliding handle 30 in addition to the rod 24 as a point of fixation. The present invention allows for a finger and hand grasp rather than just a hand grasp that may be not comfortable. Another benefit of the fixed handles is not just the extreme comfort, but it also allows the user to finger hold the clips 22*a*, 22*b* in the open position and the approach to the bow ring can be approached in different directions and individual preferences. The channel 80 through the sliding handle 30 is slightly larger than the channel 80 defined in the first and second fixed handles 28*a*, 28*b*. This allows it to have an ease of movement on the pull cable as varying temperatures may have an effect on handle materials such as plastics, metals or rubber. It is preferred that the handles be molded in half sections and then joined together around the central rod 24. The fixed handles and the sliding handle 30, have the same basic parts, except that the inset screws of the fixed handles secure it to the rod 24. The set screws, as used with the fixed handles, have the function of securing each of them to the rod 24, while the set screws used in the sliding handle 30 are mainly utilized for fixating the two halves of the handle and are not to make it integral with the rod 24.

As described already, the movable arms 44*a*, 44*b* are the active parts of the clips 22*a*, 22*b*, as this is where the tension is created as a result of the functional retractor levers 48*a*, 48*b*. This is the functional component of the clips, since by pulling either of the cables 26*a*, 26*b*, the corresponding clips open, and by releasing the cables, the corresponding clips close. As described, the present invention discusses the activation of only one clip at a time, meaning that when the first clip 22*a* is being activated by pulling on cable 26*a*, the sliding handle 30 may slide the length between it and the second fixed handle 28*b* and vice versa when the second cable 26*b* is pulled. Both cables 26*a* and 26*b* are secured in the conduits

78*a* and 78*b* of the sliding handle 30. Even though the present apparatus discusses the one clip activation, with minor variation of the sliding handle 30 one can achieve the activation of the two clips at a time. This variation involves severing the sliding handle in half such as that it resembles two fixed handles. The pull cable will terminate in each of the segmented components and instead of being one sliding handle, it will be two sliding handles with a separation between them which will allow the user to unite the two sliding handles into one by pulling them towards each other and thereby completing the length of the original sliding handle. This action will allow both clips to be opened at the same time with the user holding one hand on the joined components of the sliding handle.

An alternate clip embodiment is presented on FIGS. 6*a* to 6*d*. It is to be mentioned that the clips attached at either end of the rod 124 may be different from each other, i.e., the apparatus can have one type of clip on one end and another type on the other, there can also be identical clips on both ends although varying types of clips may be utilized. For this alternative embodiment, an effort has been made to keep the reference numerals consistent with the numerals of the preferred embodiment and merely increase by 100 each numeral shown. The drawings show only one clip, and it is to be appreciated that an alternate clip may be used at the other end of the rod.

Figure 6A:
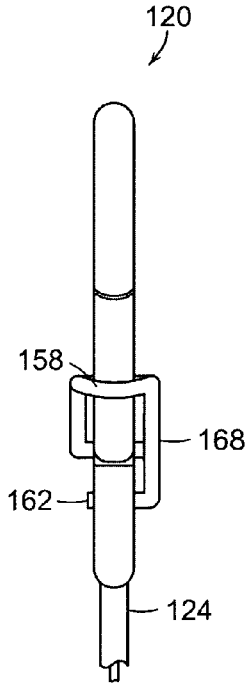
FIG. 6*a* is a left elevational view of FIG. 6.
Figure 6:
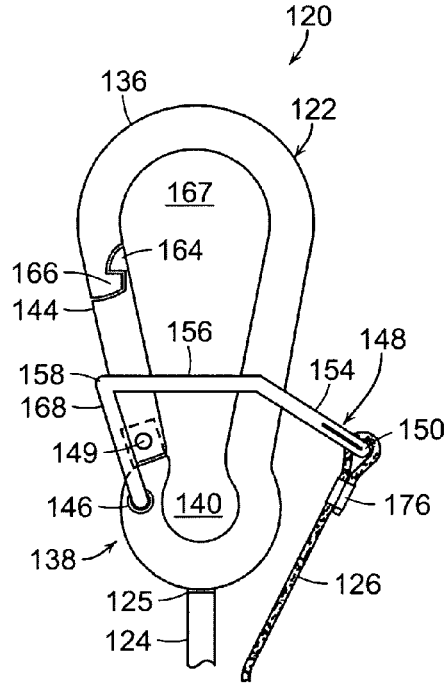
FIG. 6 is an elevational front view of an embodiment of the clip.
Figure 6B:
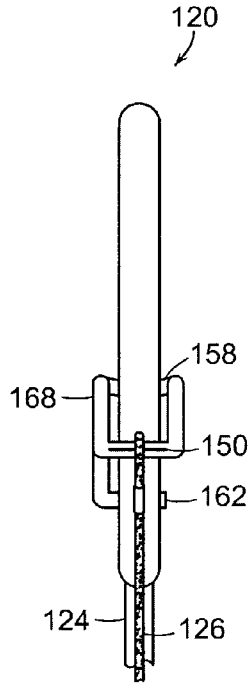
FIG. 6*b* is a right elevational view of FIG. 6.
Figure 6C:
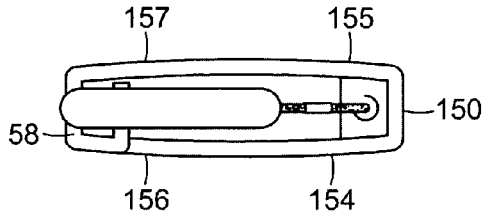
FIG. 6*c* is a top plan view of the apparatus of FIG. 6.
Figure 6D:
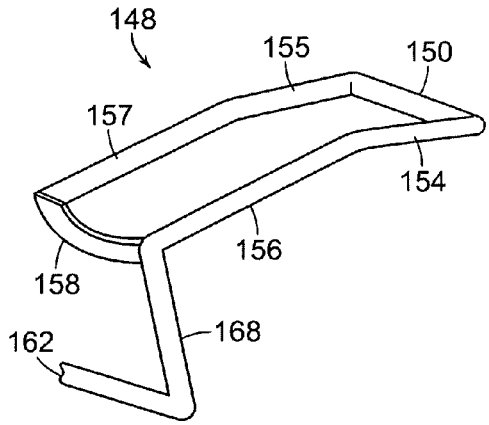
FIG. 6*d* is a pictorial view of a retractor lever used in FIG. 6.

The clip 120 as shown in FIGS. 6 to 6*d*, has its access of rotation hole 146 relocated to another area of the ring portion 138. The slight change in this alternative embodiment is necessary in that the tension placed on the movable arm 144 to biasly hold it in a closed position is supplied by a built in spring mechanism 149, which is now part of the movable arm 144. Opening and closing the clip 122 is still performed by the functional retractor lever 148. The retractor lever 148 is comprised of: a looped section 150 connected to the pull cable 126; a pair of lower and upper arm sections (FIGS. 6*c* and 6*d*), a left lower section 154 and a left upper section 156 and a right lower section 155 and a right upper section 157, each of which forms an angular deviation in relationship to each other, and it is important to note that these angular deviations may also be varied. There is included a curved functional contact section 158 for engaging the movable arm 144 when activation is required to open or shut the clip. The curvature is a critical concept as the functional contact section 158 which will have a tendency to ride up on the front facing of the movable arm 144. This curvature design allows the contact section 158 to trail the arm movement and therefore not override the extent of the movable arm 144 when it is in its most open position. It also serves as a safety mechanism because upon releasing the functional retractor lever 148, the movable arm 144 is allowed to return to its closed position and the functional contact section 158 will lower itself to its original starting position.

A leg section 168 extends in a downwardly direction and has at a distal end an extension piece 162 that frictionally fits with great bias into the axis of rotation hole 146, therein creating a leveraging anchor for the retractor lever 148. The movable arm 144 of the apparatus has an upper bridge section 164 which snap-fits into the attachment hook 166 on the hook section of the clip 122 to close it. An internal spring 149 creates the necessary tension to biasly hold the movable arm 144 in the closed position. The location for the access of rotation hole 146 was selected on the ring section 138 at a site as to not alter the clip's ability to function or weaken it. The site herein was chosen to allow insertion of the extension piece 162 which as previously stated creates an axis of rotation for the retractor lever 148. Since the movable arm 144 of the clip has an internal spring 149 located within it, holes could not be placed within its' length. If such were done, then the clip could very well be destroyed and de-activated. When activated by pulling on the cable 26, the curved functional contact section 158 engages the movable arm 144, therein causing it to rotate inwards and thus opening the clip. By curving the functional contact section 158 the lower edge is placed in contact with the movable arm 144 and there is less chance of it coming too close to the end of the movable arm. The functional contact section 158 could also be straight rather than curved but curved is preferred thereby allowing the contact section 158 to go lower.

The functional aspect of the invention, wherein when the cable 126 is pulled, it exerts a rotational force about the access of rotation hole 146, thereby applying pressure on the movable arm 144 releasing it from the hook 166 and thus opening-up. The reverse of this action is such that upon releasing the pull on the movable handle 130, the cable tension is lessened thereby closing the clip 122. It is shown on FIGS. 6 to 6*d*, that the contact section 158 embraces both, the left and right arms of the retractor lever, and when activated the pull is evenly shared by both arms, because there isn't any deviation or deformation caused by an uneven pull.

While it is apparent that the illustrative embodiments of the invention herein disclosed fulfill the objectives stated above, it will be appreciated that numerous modifications and other embodiments may be devised by those skilled in the art. Therefore, it will be understood that the appended claims are intended to cover all such modifications and embodiments which come within the spirit and scope of the present invention. It is anticipated that the apparatus has a variety of uses outside of watercraft uses.

What is claimed is:

1. A mooring pendant apparatus for use in docking a boat, wherein the apparatus releasably couples or decouples to an eyelet on the bow of the boat or to a buoy, the apparatus comprises:

an elongated rod;

a first clip and a second clip, each integrally connected to opposing ends of the rod, each clip comprises a hook section and a ring section, each clip having a mouth defined therein;

first and second movable arms, each having an upper bridge with means for biasingly locking into an upper bridge of a corresponding hook section, the means consisting of a first and a second loaded hole defined in the ring section of each clip, the movable arm of each clip having a long leg with an insertion piece on a distal end biasly fitting into the first loaded hole and a shorter leg with an insertion piece on a distal end biasly fitting into the second loaded hole, wherein each leg is biased therein causing the movable arm to be urged into a closed position;

first and second functional retractor levers, each having an activating system for controlling the opening and closing of the respective movable arm, each activating system comprising: a curved lever arm having an extension piece that is biasly fitted into an access of rotation hole defined on the ring section of the clip to maintain the retractor arm in a rotational position; lower and upper arm sections forming an angular deviation in relationship to each other; an engagement section that is in functional contact with the long and short legs of the movable arm; and a loop section attached to a cable which causes the clip to open upon a pull of the cable and close upon releasing the cable; and means for guiding and controlling each cable, means including first and second fixed handles attached to the rod for maintaining position of the respective first and second cables passing through them; and a sliding handle attached in a sliding relationship to the rod, securely holding both ends of the cables, wherein a boater may pull on either the first or second cables with sufficient force to overcome biasly locked movable arms, therein causing either the first or second clip to open.

2. The apparatus of claim 1, wherein the clips, functional retractor arm, and elongated rod are formed out of stainless steel or brass.

3. The apparatus of claim 1, wherein the cable is formed from a wire, or airplane cable, or polyvinylchloride coated steel.

* * * * *